US010828896B1

(12) United States Patent
Byun et al.

(10) Patent No.: US 10,828,896 B1
(45) Date of Patent: Nov. 10, 2020

(54) INDUCED ELECTROHYDRODYNAMIC JET PRINTING APPARATUS

(71) Applicant: ENJET CO. LTD., Suwon-si (KR)

(72) Inventors: Do Young Byun, Seoul (KR); Vu Dat Nguyen, Suwon-si (KR); Yong Hee Jang, Suwon-si (KR)

(73) Assignee: ENJET CO. LTD., Suwon-si (KR)

( * ) Notice: Subject to any disclaimer, the term of this patent is extended or adjusted under 35 U.S.C. 154(b) by 0 days.

(21) Appl. No.: 16/542,885

(22) Filed: Aug. 16, 2019

(30) Foreign Application Priority Data

Apr. 16, 2019 (KR) ..... 10-2019-0044470

(51) Int. Cl.
*B41J 2/14* (2006.01)

(52) U.S. Cl.
CPC ..... *B41J 2/14314* (2013.01)

(58) Field of Classification Search
CPC ..... B41J 2/14314
See application file for complete search history.

(56) References Cited

U.S. PATENT DOCUMENTS

| | | | | |
|---|---|---|---|---|
| 4,333,086 | A | 6/1982 | Ebi | |
| 4,364,054 | A | 12/1982 | Kelly | |
| 2006/0197803 | A1* | 9/2006 | Steiner | B41J 2/09 347/55 |

FOREIGN PATENT DOCUMENTS

| | | | |
|---|---|---|---|
| JP | 9-164688 | A | 6/1997 |
| JP | 2004-165587 | A | 6/2004 |
| JP | 2006-297754 | A | 11/2006 |
| KR | 10-0625015 | B1 | 9/2006 |
| KR | 10-2017-0108972 | A | 9/2017 |

* cited by examiner

*Primary Examiner* — Bradley W Thies
(74) *Attorney, Agent, or Firm* — Saliwanchik, Lloyd & Eisenschenk

(57) ABSTRACT

Disclosed is an induced electrohydrodynamic (EHD) jet printing apparatus including: a nozzle configured to discharge a fed solution to an opposite substrate; a main electrode contactlessly isolated from the solution inside the nozzle by an insulator; and a voltage supplier configured to apply voltage to the main electrode.

19 Claims, 16 Drawing Sheets

0.4kV~ printable 15~16um width 0.4kV~ printable 13~14um width 0.4kV~ printable 8~10um width 8~10um 0.95kV~ printable 7~8um width 7~8um

INDUCED ELECTROHYDRODYNAMIC JET PRINTING APPARATUS

CROSS-REFERENCE TO RELATED APPLICATION

This application claims priority to Korean Application No. 10-2019-0044470, filed Apr. 16, 2019, which is hereby incorporated by reference in its entirety.

BACKGROUND OF THE INVENTION

(a) Field of the Invention

The disclosure relates to an electrohydrodynamic jet printing apparatus based on induced electrostatic force depending on an electric charge induced under an electric field, and more particularly to an induced electrohydrodynamic jet printing apparatus that discharges a solution charged by electrostatic force induced on a liquid surface at a nozzle tip under an electric field.

(b) Description of the Related Art

In general, an inkjet printer or a dispenser refers to an apparatus that is coupled to an airtight container filed with gas, liquid or the like contents and used to discharge out the content by certain amounts with a pressing means or a pressure-wave transfer means such as a piezoelectric device.

Recently, the dispenser has also been used to discharge out a liquid chemical for specific partial coating, bonding, etc. in electronic parts, camera modules, and the like small precision industry field. Further, the inkjet printer has been used for coating an organic film of an encapsulation process or pattering red, green and the like color material of a pixel even in an organic light emitting diode (OLED) display industry field. Besides, ink and the like material have been taken into account to reconnect broken (open) electrodes such as a source, a drain, a gate, etc. of a thin film transistor on an OLED backplane. To be used in such a field, the dispenser or printer is further required to more precisely control a discharging amount and discharge a finer liquid droplet.

As a liquid-droplet jet method, there have been widely used a piezoelectric method, an electrohydrodynamic (EHD) method, etc. Among them, the EHD method refers to a method of discharging ink based on electrostatic force depending on electric potential difference between an electrode inside a nozzle and a substrate, and has been widespread in a technical field for precise discharge because it can achieve a fine linewidth.

In conventional EHD jet techniques, an electrode is placed inside a nozzle and voltage is applied thereto, so that solution in the nozzle can be charged with supplied electric charges, thereby generating electrostatic force and discharging output a liquid droplet. Besides, a nozzle is made of a conductive material, so that the nozzle can serve as an electrode. Even in this case, a liquid droplet is discharged by applying voltage to the nozzle. Further, the outside of the nozzle is coated with a conductive material to form an electrode and supply electric charges while being in contact with a solution at a nozzle tip, thereby discharging out the solution. When the electrode is in contact with liquid, a free electron moves from the electrode to the liquid, or an ion is formed by dissociation from the surface of the electrode and moves, thereby making an electric current flow in the liquid. In this case, the liquid is discharged by electrostatic force exerted depending on strength of an electric field formed as voltage is applied to the nozzle electrode. Usually, functional inks to be discharged are made by dispersing nanometal particles, polymer, bio materials, binder, and the like materials to various solvents. Such materials have electric charges in themselves and contribute the formation of ions by activating the dissociation on the electrode.

However, such conventional EHD jet techniques are based on a structure that the electrode is in direct contact with the solution in the nozzle, and therefore electrode ions generated from the electrode by an oxidation-reduction reaction on the surface of the electrode during the dissociation are mixed with the solution for the jet in the nozzle, thereby causing a problem that the solution is denatured by heat generated in the oxidation-reduction reaction. In this case, the denaturation of the solution may cause a problem of making the nozzle clog up, and a serious problem with the jet due to generated bubbles. Further, the electric current may flow back according to the electric conductivity of the solution, and thus cause a malfunction of a valve that may be present between the nozzle and a solution chamber.

PRIOR ART BIBLIOGRAPHY

Patent Documents

U.S. Pat. No. 4,333,086
U.S. Pat. No. 4,364,054
Japanese Patent Publication No. 2004-165587

SUMMARY OF THE INVENTION

Accordingly, the disclosure is conceived to solve the foregoing problems, and an aspect of the disclosure is to provide an induced electrohydrodynamic jet printing apparatus, in which an insulator isolates solution in a nozzle from an electrode to which voltage is applied, and the solution is discharged from the nozzle by electrostatic force based on an electric charged (or an induced charge) induced under an electric field generated when the voltage is applied to the electrode, thereby solving conventional problems of generation of heat, denaturation of the solution, clogging of the nozzle, and generation of bubbles, caused by an oxidation-reduction reaction due to direct contact between the solution and the electrode.

The problems to be solved by the disclosure are not limited to those mentioned above, and other unmentioned problems will become apparent to a person skilled in the art by the following descriptions.

In accordance with an embodiment of the disclosure, there is provided an induced electrohydrodynamic (EHD) jet printing apparatus including: a nozzle configured to discharge a fed solution to an opposite substrate; a main electrode contactlessly isolated from the solution inside the nozzle by an insulator; and a voltage supplier configured to apply voltage to the main electrode.

Here, the voltage supplier may apply a direct current (DC) voltage to the main electrode.

Here, the voltage supplier may apply an alternating current (AC) voltage to the main electrode.

Here, the voltage supplier may apply the AC voltage, which includes a waveform of at least one among a sinusoidal wave, a triangle wave, and a square wave, to the main electrode.

Here, the main electrode may be coated with the insulator and inserted into the nozzle.

Here, the main electrode may be shaped like a needle.

Here, the main electrode may be shaped like a tube.

Here, the induced EHD jet printing may further include an inducement-assistant electrode which is made of a conductive material and coated on an inner wall of the nozzle, and which does not have electric connection, is supplied with voltage different in level from the voltage for the main electrode, or grounded.

Here, a surface of the inducement-assistant electrode may been coated with an insulator.

Here, the nozzle may been formed of the insulator, and the main electrode may be formed on an outer wall of the nozzle or at a position spaced apart from an outside of the nozzle.

Here, the nozzle may include a main electrode portion made of a conductive material and forming a body, and an insulating portion made of the insulator and coated on the main electrode portion, and the voltage supplier may be configured to apply voltage to the main electrode portion.

Here, the induced EHD jet printing apparatus may further include an inducement-assistant electrode which is made of a conductive material and inserted into the nozzle, and which does not have electric connection, is supplied with voltage different in level from the voltage for the main electrode, or grounded.

Here, the induced EHD jet printing apparatus may further include an inducement-assistant electrode which is made of a conductive material and inserted into the nozzle, and which does not have electric connection, is supplied with voltage different in level from the voltage for the main electrode portion, or grounded.

Here, the inducement-assistant electrode may be shaped like a needle.

Here, the inducement-assistant electrode may be provided as aluminum foil and inserted into the nozzle.

Here, a surface of the inducement-assistant electrode may been coated with an insulator.

BRIEF DESCRIPTION OF THE DRAWINGS

The above and/or other aspects of the disclosure will become apparent and more readily appreciated from the following description of the exemplary embodiments, taken in conjunction with the accompanying drawings, in which.

DETAILED DESCRIPTION

Details of embodiments are involved in the detailed description and the accompanying drawings.

The merits and features of the disclosure, and methods of achieving them will become apparent with reference to the embodiments described below in detail and the accompanying drawings. However, the disclosure is not limited to the embodiments set forth herein, but may be implemented in various forms. The following embodiments are provided in order to fully describe the disclosure and enable those skilled in the art, to which the disclosure pertains, to understand the disclosure, the scope of which is defined in the appended claims. Like numerals refer to like elements throughout.

Below, embodiments of an induced electrohydrodynamic (EHD) jet printing apparatus according to the disclosure will be described with reference to the accompanying drawings.

First, an induced EHD jet printing apparatus according to an embodiment of the disclosure will be described with reference to FIGS. 1 to 4.

Figure 1:
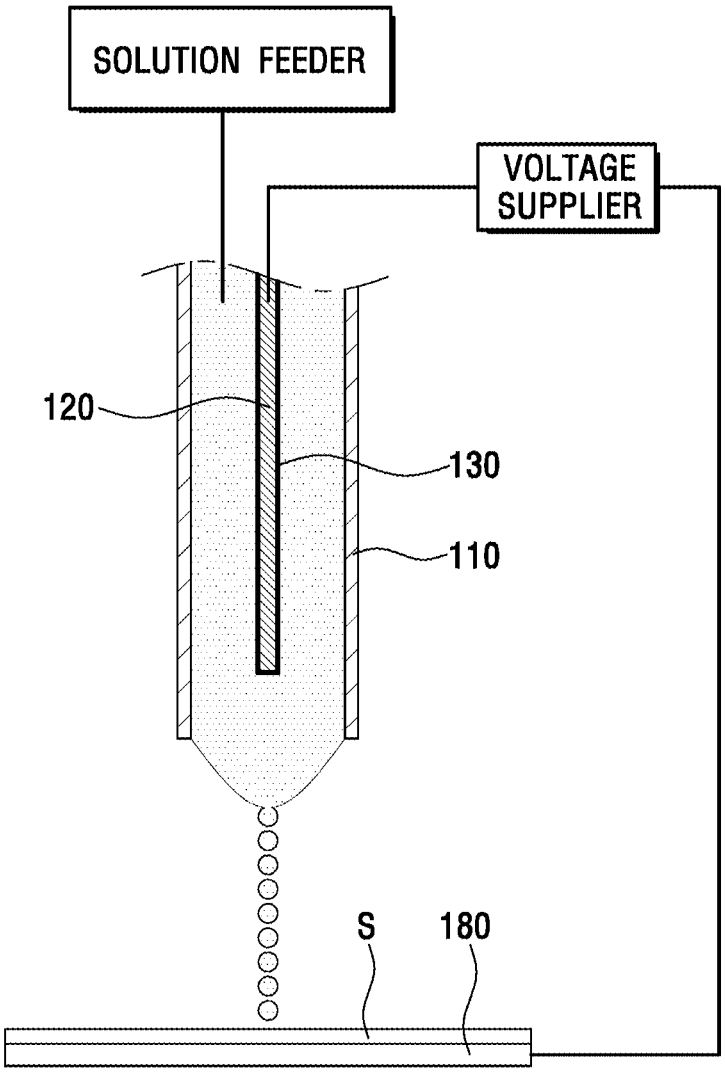
FIG. 1 is a cross-sectional view showing major parts of an induced electrohydrodynamic (EHD) jet printing apparatus according to an embodiment of the disclosure.
Figure 2:
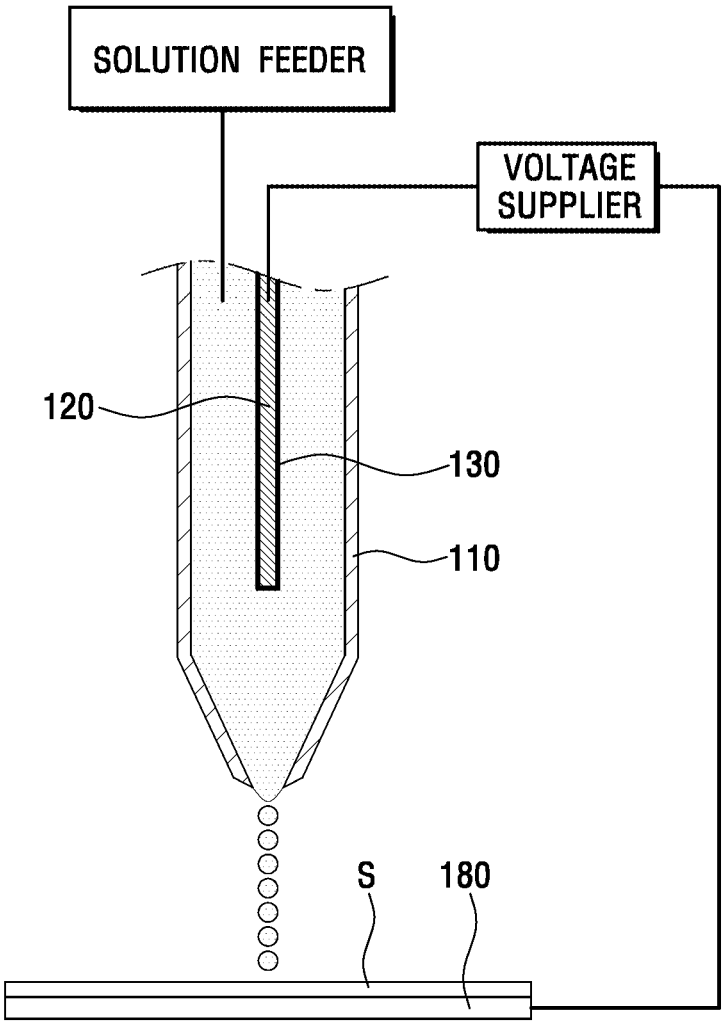
FIG. 2 shows an alternative example of FIG. 1.
Figure 3:
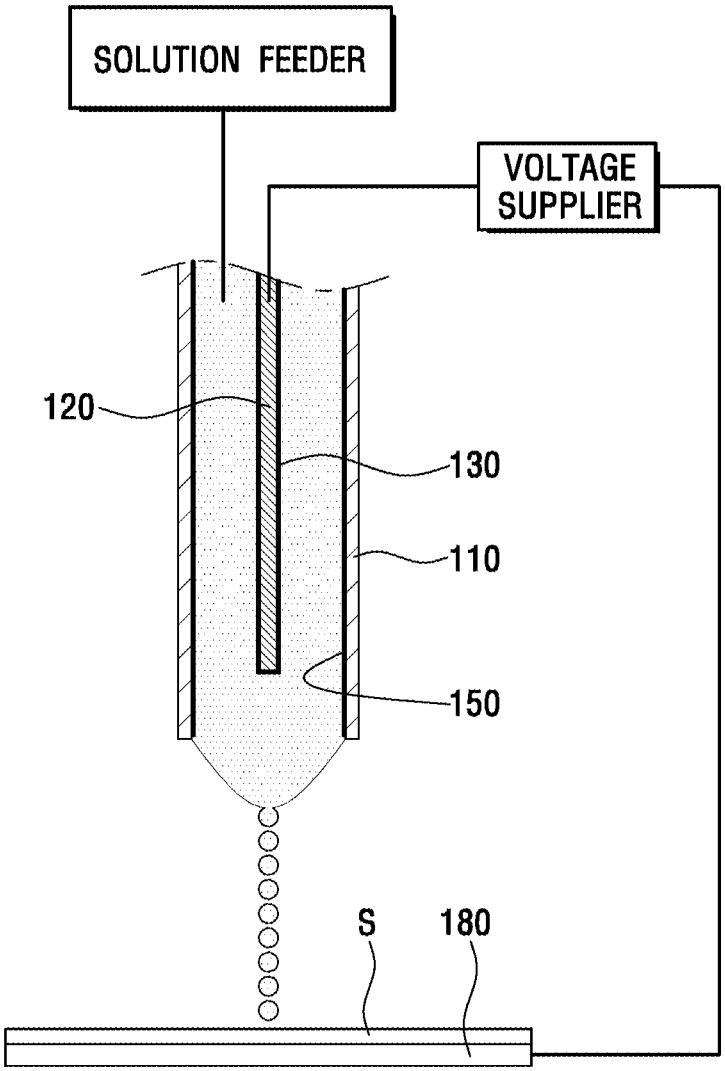
FIG. 3 shows another alternative example of FIG. 1.
Figure 4:
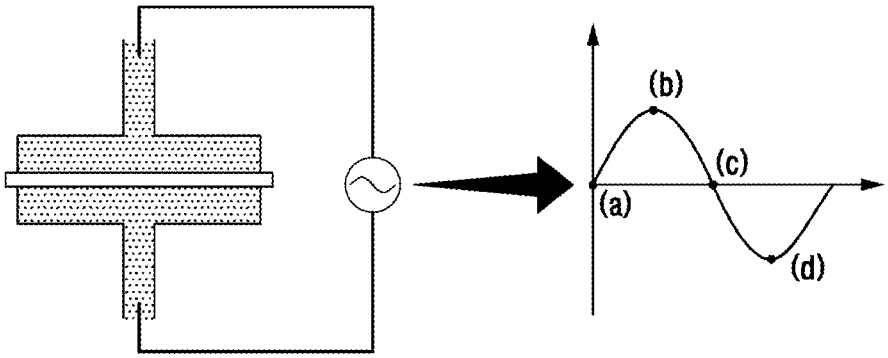
FIG. 4 illustrates that a charged state is changed by a displacement current a when an alternating current (AC) voltage is applied to a capacitor, to explain a principle of the disclosure.
Figure 4:
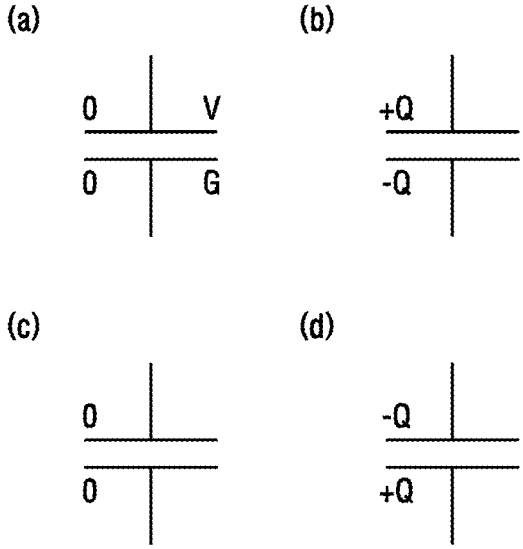

FIG. 1 is a cross-sectional view showing major parts of an induced EHD jet printing apparatus according to an embodiment of the disclosure, FIG. 2 shows an alternative example of FIG. 1, FIG. 3 shows another alternative example of FIG. 1, and FIG. 4 illustrates that a charged state is changed by a displacement current a when an alternating current (AC) voltage is applied to a capacitor, to explain a principle of the disclosure.

According to an embodiment of the disclosure, the induced EHD jet printing apparatus may include a nozzle 110, a main electrode 120 and a voltage supplier. Further, the induced EHD jet printing apparatus may further include an inducement-assistant electrode 150.

The nozzle 110 receives solution from a solution feeder, and discharges out the solution through a nozzle hole formed on a lower end thereof, based on electrostatic force induced by a direct current (DC) or AC voltage applied to the main electrode 120 to be described below. In this case, the nozzle 110 is shaped like a cylinder, of which a cross-section is circular and an inner diameter is constant from an upper end to the lower end. However, the nozzle 110 is not limited to this shape. As shown in FIG. 2, a lower end portion of the nozzle 110 formed with the nozzle hole may be tapered downward with a decreasing inner diameter. Alternatively, the nozzle may be shaped like a quadrangular cylinder, a polygonal cylinder, etc.

In this case, the nozzle hole, through which the solution is discharged out, may be formed to have a diameter not greater than 50 μm, or as necessary not greater than 1 μm.

The solution feeder may be actualized by a pump, a valve, etc. and feed the solution into the nozzle 110 at predetermined pressure.

The main electrode 120 is inserted in the nozzle 110 at the center and receives a DC or AC voltage from the voltage supplier. The main electrode 120 may be provided in the form of a needle as shown in the accompanying drawings.

In this case, the main electrode 120 according to this embodiment is externally coated with an insulator to thereby form an insulating layer 130. Therefore, the main electrode 120 does not directly contact the solution inside the nozzle 110 but is isolated from the solution by the insulating layer 130. Because the insulating layer 130 isolates the solution inside the nozzle 110 from the main electrode 120, a oxidation-reduction reaction between the solution and the main electrode 120 is inhibited from occurring when high voltage is applied to the main electrode 120, thereby solving problems of generation of heat, denaturation of the solution, generation of bubbles, clogging of the nozzle 110, etc. caused by the oxidation-reduction reaction.

In this case, a coating agent of epoxy polymer, fluororesin (fluorocarbon), etc. is used as the insulator forming the insulating layer 130 according to this embodiment. To insulate the electrode, an oxidation film may be formed on a metal surface, or epoxy or phenolic polymer coating, ceramic coating, glass coating, etc may be used without limitations.

The voltage supplier applies the DC or AC voltage to the main electrode 120 positioned inside the nozzle 110. In this case, the voltage applied by the voltage supplier may have various waveforms like a sinusoidal wave, a triangle wave, a square wave, etc.

Another electrode 180 may be formed beneath a substrate S to which the solution is discharged, and the voltage supplier is electrically connected between the electrode 180 beneath the substrate S and the main electrode 120 and applies the voltage. The electrode 180 beneath the substrate S may be grounded.

$$\vec{f}_e = \rho_e \vec{E} - \frac{1}{2}|\vec{E}|^2 \nabla_\varepsilon + \nabla\left(\frac{1}{2}(\varepsilon - \varepsilon_0)|E|^2\right) \quad \text{[Expression 1]}$$

The expression 1 expresses force exerted on solution under an electric field. (where, $f_e$ is electric force, $\rho_e$ is density of an electric charge, E is a dielectric coefficient, $\varepsilon_0$ is a dielectric constant in vacuum, and E is strength of an electric field.)

The first term at the right side shows Coulomb force which is exerted on the solution including free electric charge. This is the strongest force as exerted by the electric charge transferred when the solution is in direct contact with the electrode. In this embodiment, the Coulomb force may be exerted by an induced current formed when the AC voltage is applied to the main electrode 120. The second term shows dielectric force formed when the electric field is applied to non-homogeneous dielectric liquid. The dielectric force is weaker than the Coulomb force when the electrode is in direct contact with the liquid, but may be largely exerted when the induced current is used like this embodiment. The third term shows force caused by electrostrictive pressure, as force of pressure produced when the electric field is non-uniformly distributed on the liquid surface of the liquid.

As shown the upper left side of in FIG. 4, a capacitor refers to a circuit element in which a dielectric made of an insulating material is sandwiched between two conductive metal plates. In this case, the capacitor serves as a charger in which no current flows when DC voltage is applied, but causes a phenomenon that flow of electric charge is alternately change, i.e. a displacement current when AC voltage is applied.

According to the disclosure, the solution in the nozzle 110 and the main electrode 120 are isolated by the insulating layer 130 coated on the outer surface of the main electrode 120 like when AC voltage is applied to the capacitor, and the induced electric charge acts upon the solution in the nozzle 110 as an electric signal alternates between '+' and '−' when AC voltage is applied to the main electrode 120, thereby having an effect on making electric current flow. Therefore, the solution is charged by electric force induced by AC voltage supplied from the voltage supplier, thereby forming an electric field and discharging liquid based on Coulomb force.

According to the disclosure, in a case that DC voltage is applied to the main electrode 120, when liquid is a polar solvent and an electric field is formed between a liquid surface at the nozzle tip and the substrate even though the voltage is applied to the electrode insulated by the insulating layer 130, an induced electric charge is formed along the liquid surface by polarization and Coulomb force acts based on the electric field. When the solution contains polymer, nanoparticles, biomaterials, and the like having an electric charge, the electric field also makes the electric charge be distributed on the liquid surface according to the electric charge of the materials and the electric field, thereby additionally exerting electric force. Further, dielectric force and electrostrictive pressure force may contribute to the liquid discharging in the induced EHD jet printing of the disclosure.

In this case, as shown in FIG. 3, this embodiment may further include the inducement-assistant electrode 150 inside the nozzle 110. In more detail, the inducement-assistant electrode 150 may be formed by coating the inner surface of the nozzle 110 with a conductive material. Alternatively, the nozzle may be made of the conductive material. For example, the nozzle may be made of Cu, Al, Ni, Fe, SUS, alloy thereof, or the like material and employed as the inducement-assistant electrode. The inducement-assistant electrode 150 does not have separate electric connection, is supplied with voltage different in level from that of the main electrode 120, or is grounded.

In such a case that the inducement-assistant electrode 150 is formed inside the nozzle 110 in addition to the main electrode 120, the induced electric field is further reinforced when AC voltage is applied to the main electrode 120 and the induced current is generated in the solution, thereby improving a jet characteristic.

From the point of view of forming the induced electric field, the main electrode 120 may be regarded as an emitting electrode for emitting an electric signal, and the inducement-assistant electrode 150 may be regarded as a receiving electrode for receiving the electric signal from the main electrode 120. Therefore, only the presence of the inducement-assistant electrode 150 is enough to reinforce the induced electric field without the electric connection of the inducement-assistant electrode 150, thereby further enhancing the jet characteristic. In this regard, the jetting results will be described with reference to FIGS. 11 and 12.

In this case, even the surface of the inducement-assistant electrode 150 may be coated with the insulator to thereby inhibit direct contact with the solution inside the nozzle 110.

Next, an induced electrohydrodynamic (EHD) jet printing apparatus according to another embodiment of the disclosure will be described with reference to FIGS. 5 and 6.

Figure 5:
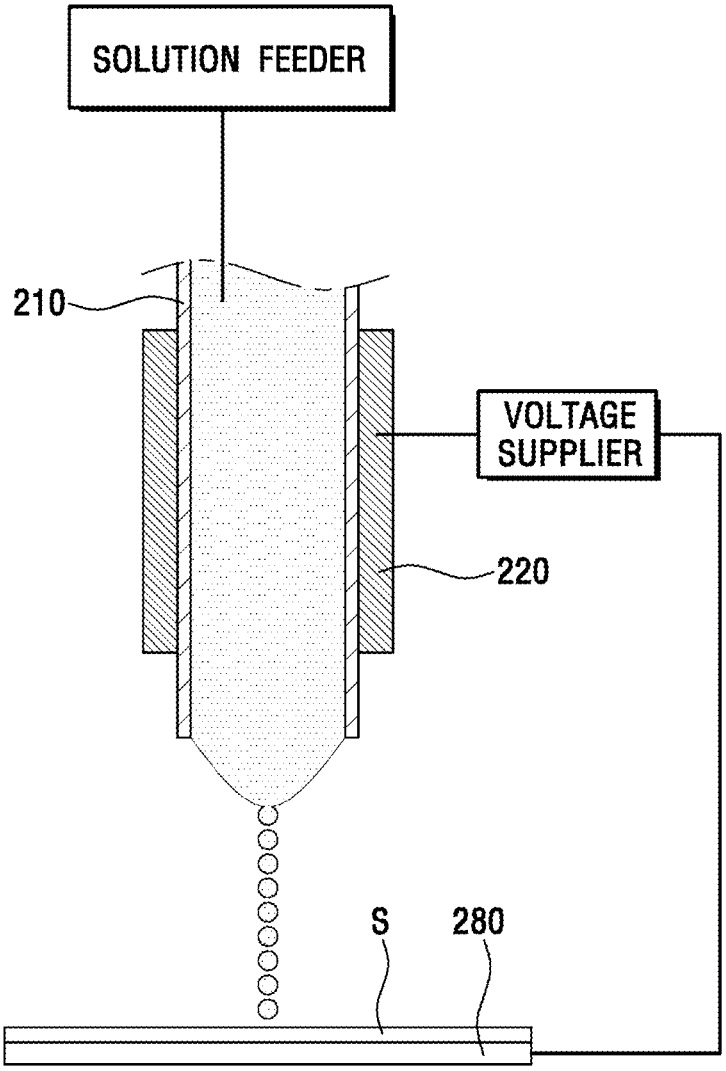
FIG. 5 is a view showing major parts of an EHD jet printing apparatus according to another embodiment of the disclosure.
Figure 6:
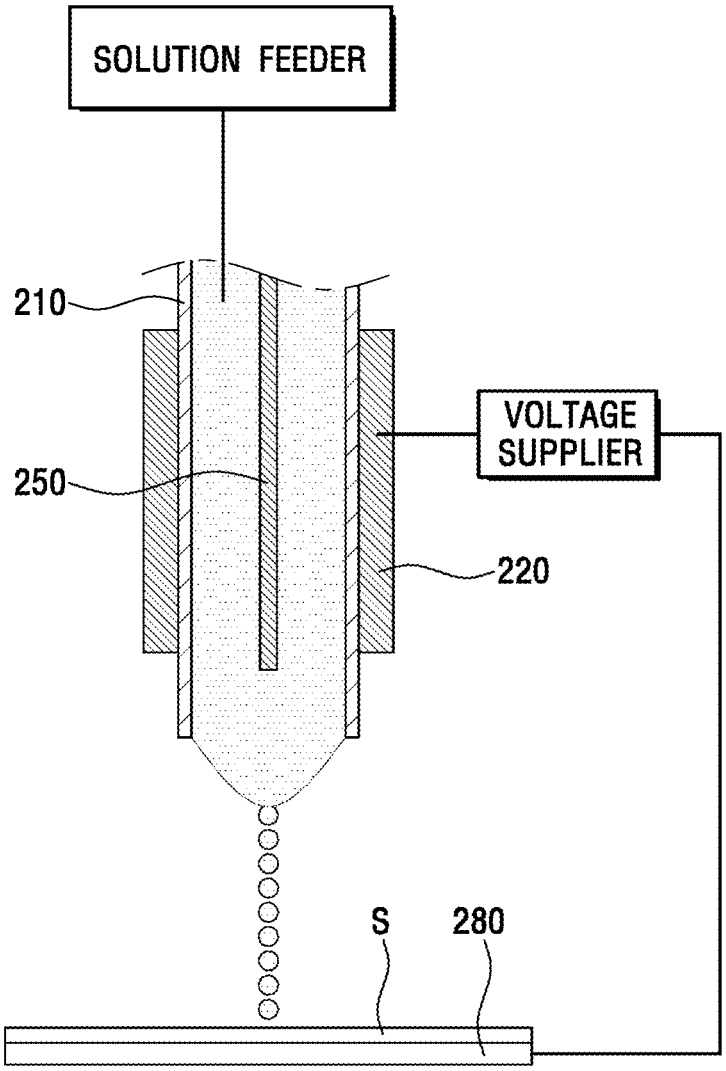
FIG. 6 shows an alternative example of FIG. 5.

FIG. 5 is a view showing major parts of an EHD jet printing apparatus according to another embodiment of the disclosure, and FIG. 6 shows an alternative example of FIG. 5.

The induced EHD jet printing apparatus according to this embodiment of the disclosure may also include a nozzle 210, a main electrode 220, and a voltage supplier. Further, the induced EHD jet printing apparatus may further include an inducement-assistant electrode 250.

The following descriptions will be made focusing difference from the foregoing embodiment described with reference to FIGS. 1 to 4.

The nozzle 210 in this embodiment receives solution from a solution feeder, and discharges out the solution through a nozzle hole formed on a lower end thereof, based on induced electrostatic force. In this case, the nozzle 210 is shaped like a cylinder, of which a cross-section is circular and an inner diameter is constant from an upper end to the lower end. As shown in FIG. 2, a lower end portion of the nozzle 210 may be tapered downward with a decreasing inner diameter. Alternatively, the nozzle may be shaped like a quadrangular cylinder, a polygonal cylinder, etc. In this embodiment, the nozzle 210 is made of the insulator.

The main electrode 220 may be formed on the outer surface of the nozzle 210 or disposed at a position at a predetermined distance from the outside of the nozzle 210 and receive DC or AC voltage from the voltage supplier. In this case, the main electrode 220 may be formed by coating the outer surface of the nozzle 210 with an electrically conductive material.

Therefore, according to this embodiment, the nozzle 210 is made of the insulator and the main electrode 220 is formed outside the nozzle 210, so that the solution in the nozzle 210 can be isolated from the main electrode 220 by the nozzle 210 made of the insulator like the foregoing embodiment. In this case, when the AC voltage from the voltage supplier is applied to the main electrode 220, the solution is discharged through the nozzle hole based on force of an electric field induced as an induced current flows in the solution inside the nozzle 210. Further, when the DC voltage from the voltage supplier is applied to the main electrode 220, the solution is discharged based on electric force induced as an induced electric charge is formed on the liquid surface of the solution at the tip of the nozzle 210.

In this case, the inducement-assistant electrode 250 in this embodiment may be formed like that of the foregoing embodiment. As shown in FIG. 6, the inducement-assistant electrode 250 may be made of a conductive material and inserted into the nozzle 210 in the form of a needle. In this case, the inducement-assistant electrode 250 does not have separate electric connection, is supplied with voltage different in level from that of the main electrode 120, or is grounded. Alternatively, the inducement-assistant electrode 250 may be made of a conductive material and inserted into the nozzle 210 in the form of a tube as it does not have separate electric connection is supplied with voltage different in level from that of the main electrode 120, or is grounded. Alternatively, the inducement-assistant electrode 250 may be made of a conductive material and inserted into the nozzle 210 in the form of a flat plate as it does not have separate electric connection is supplied with voltage different in level from that of the main electrode 120, or is grounded.

Like that of the foregoing embodiment described with reference to FIG. 3, the inducement-assistant electrode 250 reinforces the induced electric field when the induced current is generated by applying AC voltage to the main electrode 220 and, thereby improving a jet characteristic. In this embodiment, the outside of the inducement-assistant electrode 250 may be coated with the insulator. Even without the electric connection of the inducement-assistant electrode 250, the presence of the inducement-assistant electrode 250 inside the nozzle is enough to assist the nozzle tip in focusing the electric field thereon, thereby making more electric charges be induced on the liquid surface of the nozzle tip.

Next, an induced electrohydrodynamic (EHD) jet printing apparatus according to still another embodiment of the disclosure will be described with reference to FIGS. 7 and 8.

Figure 7:
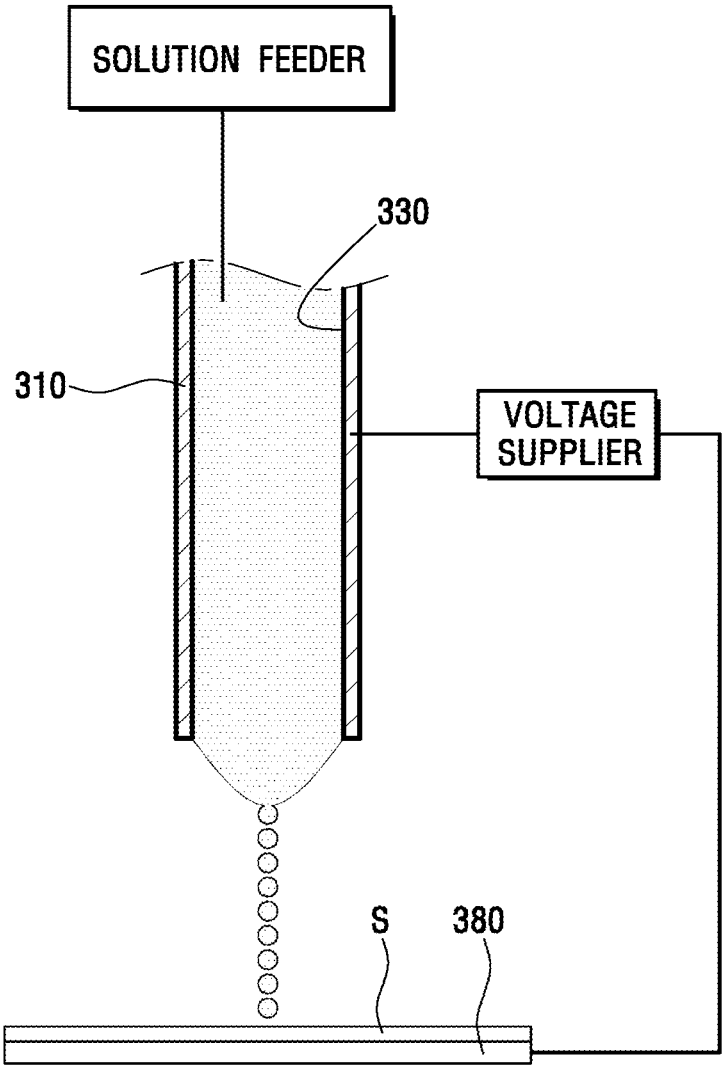
FIG. 7 is a view showing major parts of an EHD jet printing apparatus according to still another embodiment of the disclosure.
Figure 8:
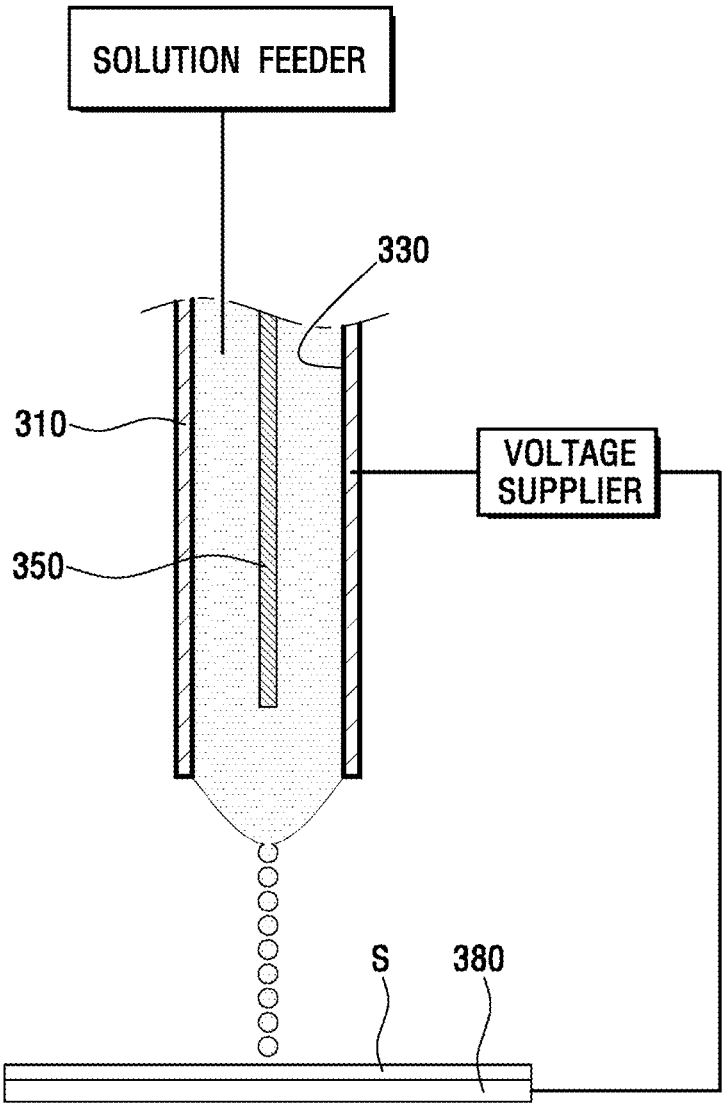
FIG. 8 shows an alternative example of FIG. 7.

FIG. 7 is a view showing major parts of an EHD jet printing apparatus according to still another embodiment of the disclosure, and FIG. 8 shows an alternative example of FIG. 7.

The induced EHD jet printing apparatus according to this embodiment of the disclosure may include a nozzle, and a voltage supplier. Further, the induced EHD jet printing apparatus may further include an inducement-assistant electrode 350. The following descriptions will be made focusing difference from the foregoing embodiments described with reference to FIGS. 1 to 6.

The nozzle in this embodiment includes a main electrode portion 310 and an insulating portion 330. The main electrode portion 310 is made of a conductive material and forms a body of the nozzle. The insulating portion 330 is formed by coating the outer surface of the main electrode portion 310 with an insulator. In this case, the insulating portion 330 may be formed on only a lateral surface forming the inner diameter of the nozzle. Alternatively, the insulating portion 330 may be formed on the entire outer surface of the main electrode portion 310 forming the body of the nozzle as shown in FIGS. 7 and 8.

Therefore, the main electrode portion 310 made of the conductive material and forming the body of the nozzle in this embodiment may serve as the main electrodes 120 and 220 of the foregoing embodiments. The insulating portion 330 formed on the outer surface of main electrode portion 310 makes the solution in the nozzle and the main electrode portion 310 be isolated without direct contact. Therefore, when Ac voltage from the voltage supplier is applied to the main electrode portion 310, the solution is discharged through the nozzle hole based on force of an electric field induced as an induced current flows in the solution inside the nozzle. Further, even when DC voltage from the voltage supplier is applied to the main electrode portion 310, the solution is discharged based on induced electric force as the induced electric charge is formed on the liquid surface.

In this embodiment, the nozzle is shaped like a cylinder, of which a cross-section is circular and an inner diameter is constant from an upper end to a lower end. As described with reference to FIG. 2, a lower end portion of the nozzle may be tapered downward with a decreasing inner diameter. Alternatively, the nozzle may be shaped like a quadrangular cylinder, a polygonal cylinder, etc.

In this case, the inducement-assistant electrode 350 in this embodiment may be formed like that of the foregoing embodiment described with reference to FIG. 6. As shown in FIG. 8, the inducement-assistant electrode 350 may be made of a conductive material and inserted into the nozzle in the form of a needle. In this case, the inducement-assistant electrode 350 does not have separate electric connection, is supplied with voltage different in level from that of the main electrode portion 310, or is grounded. Alternatively, the inducement-assistant electrode 350 may be made of a conductive material and inserted into the nozzle in the form of a tube or a flat plate as it does not have separate electric connection, is supplied with voltage different in level from that of the main electrode portion 310, or is grounded. Like those of the foregoing embodiments described with reference to FIGS. 3 and 6, the inducement-assistant electrode 350 reinforces the induced electric field when the induced current is generated by applying AC voltage to the main electrode portion 310, thereby improving a jet characteristic. In this embodiment, the outside of the inducement-assistant electrode 350 may be coated with the insulator.

Below, actual jet results of the induced EHD jet printing apparatus according to the disclosure will be described with reference to FIG. 9 to FIG. 14.

Figure 9:
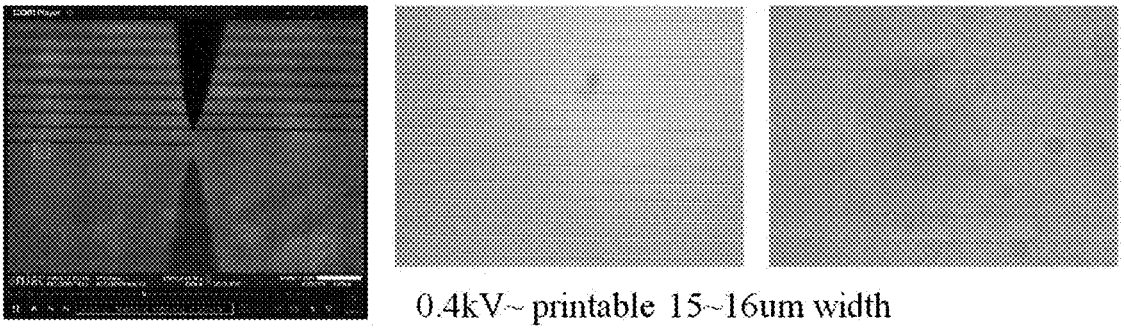
FIG. 9 is an enlarged view showing a jet result of the printing apparatus manufactured by coating a main electrode with epoxy polymer according to the embodiment of FIG. 1.
Figure 10:
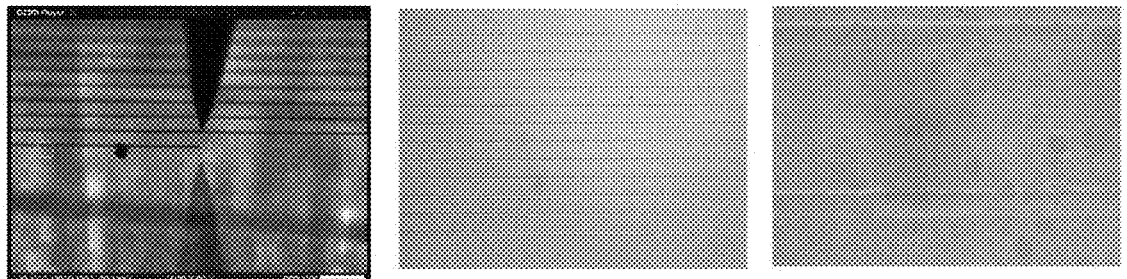
FIG. 10 is an enlarged view showing a jet result of the printing apparatus manufactured by coating a main electrode with fluoropolymer according to the embodiment of FIG. 1.
Figure 11:
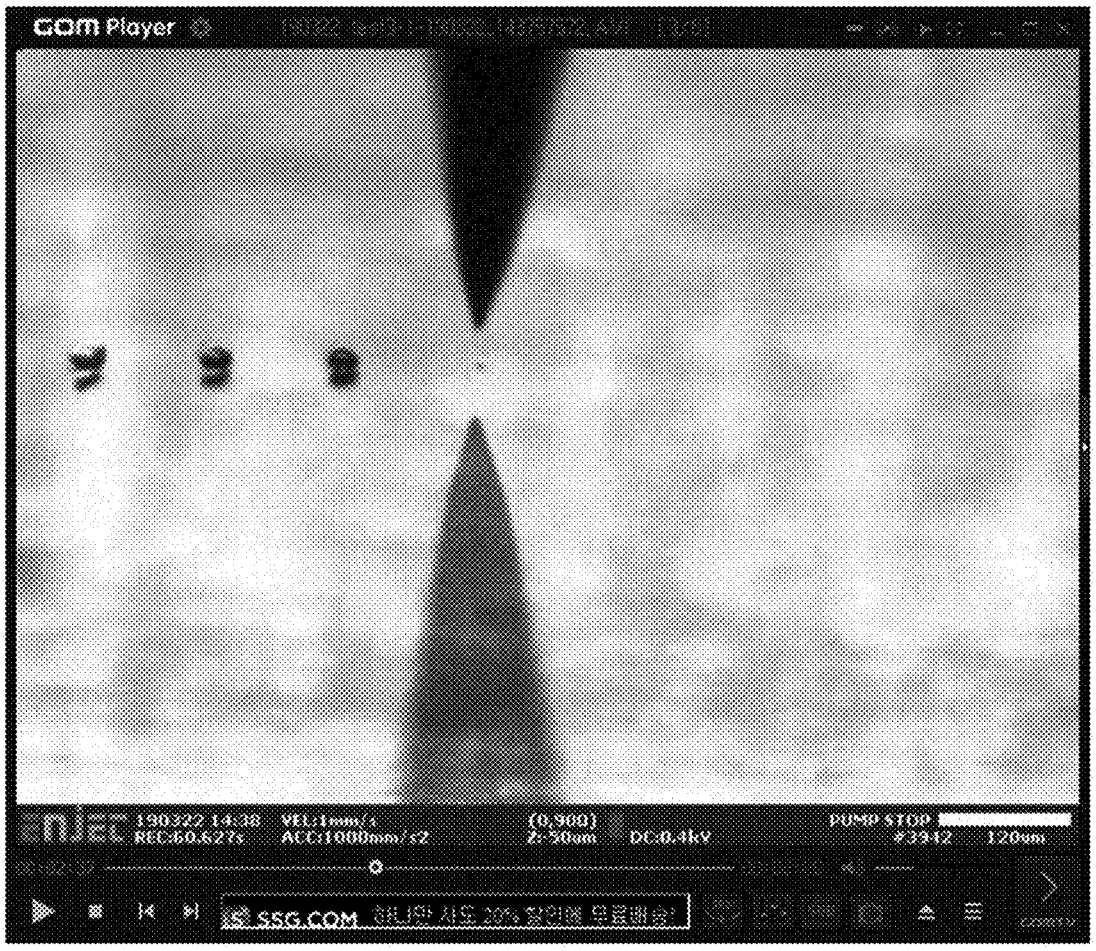
FIG. 11 is an enlarged view showing a jet result of the printing apparatus manufactured according to the embodiment of FIG. 5.
Figure 12:
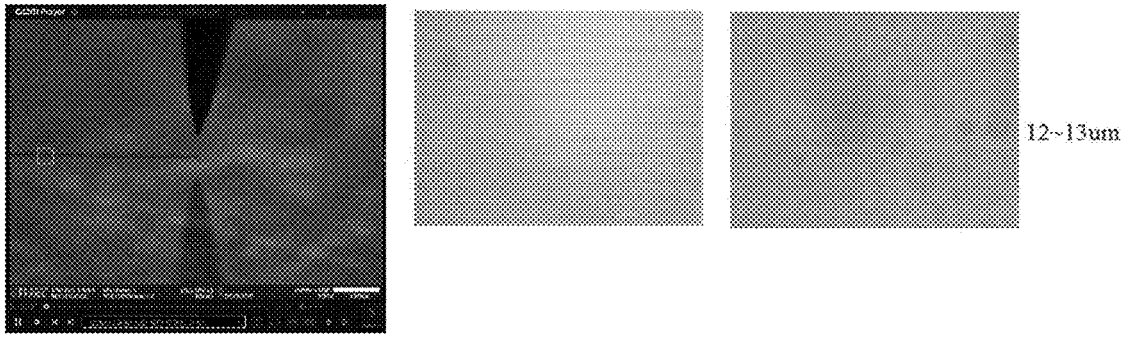
FIG. 12 is an enlarged view showing a jet result of the printing apparatus manufactured according to the embodiment of FIG. 6.
Figure 13:
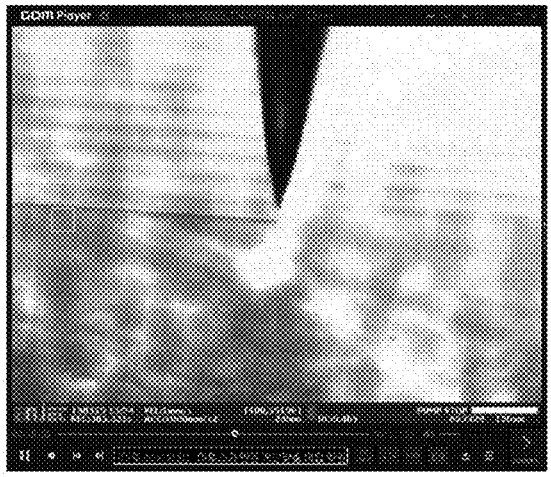
FIG. 13 is an enlarged view showing a jet result of the printing apparatus, in which an inducement-assistant electrode is provided in the form of a needle, according to the embodiment of FIG. 6.
Figure 13:
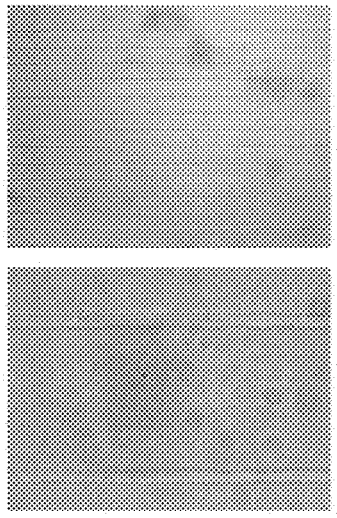
Figure 14:
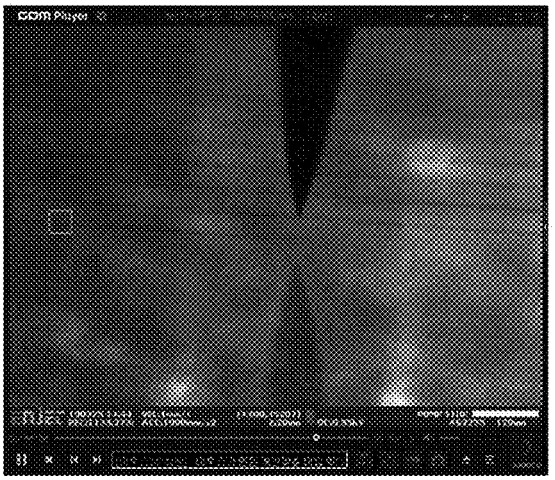
FIG. 14 is an enlarged view showing a jet result of the printing apparatus, in which an inducement-assistant electrode is provided in the form of aluminum (Al) foil, according to the embodiment of FIG. 6.
Figure 14:
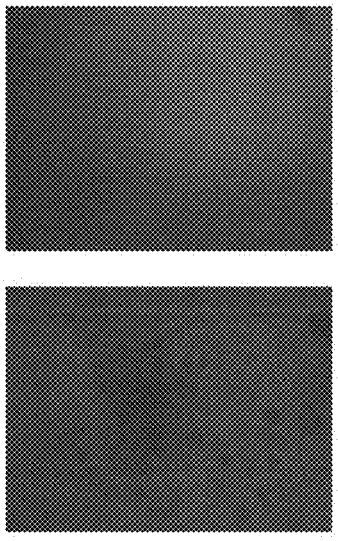
Figure 15:
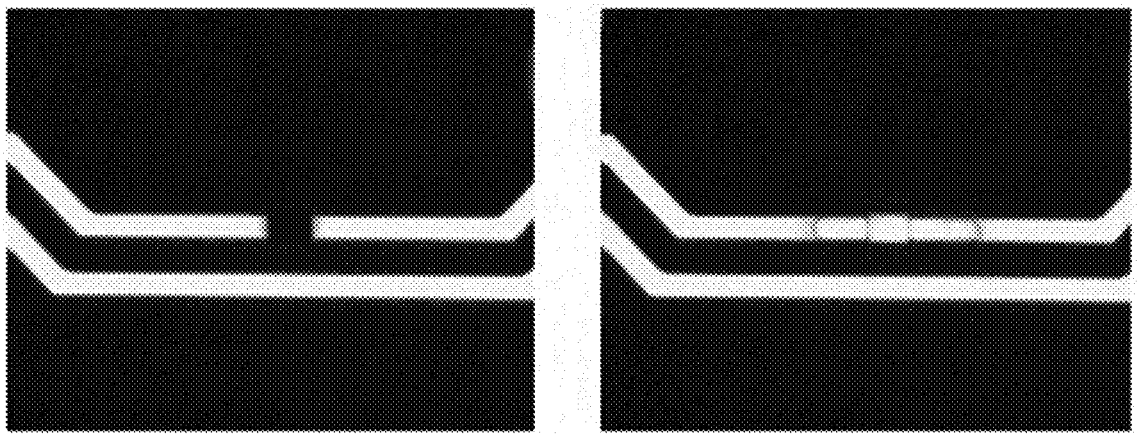
FIG. 15 is an enlarged view showing a result of repair printing for an electrode of a thin film transistor by the printing apparatus manufactured according to the disclosure.
Figure 16:
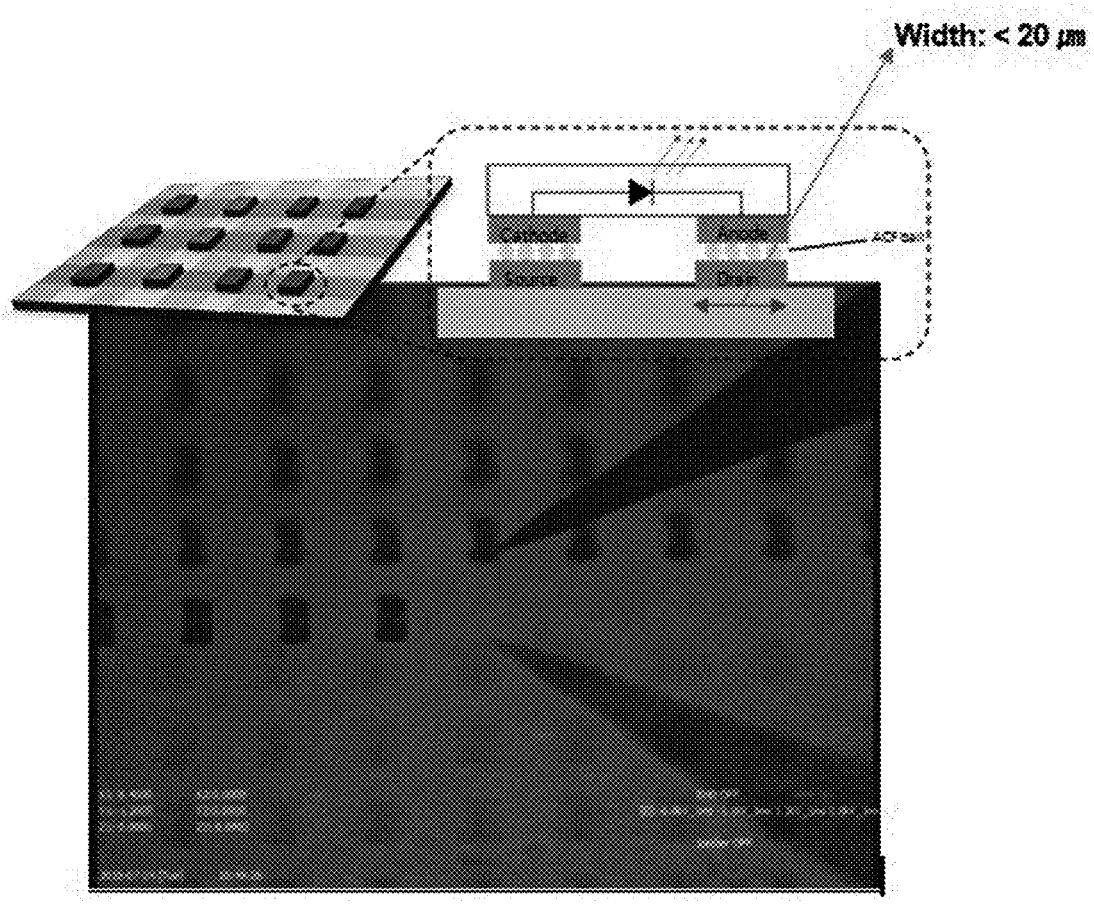
FIG. 16 is an enlarged view showing a result of printing conductive glue for bonding a micro light emitting diode (LED) by the printing apparatus manufactured according to the disclosure.

FIG. 9 is an enlarged view showing a jet result of the printing apparatus manufactured by coating a main electrode with epoxy polymer according to the embodiment of FIG. 1, FIG. 10 is an enlarged view showing a jet result of the printing apparatus manufactured by coating a main electrode with fluoropolymer according to the embodiment of FIG. 1, FIG. 11 is an enlarged view showing a jet result of the printing apparatus manufactured according to the embodiment of FIG. 5, FIG. 12 is an enlarged view showing a jet result of the printing apparatus manufactured according to the embodiment of FIG. 6, FIG. 13 is an enlarged view showing a jet result of the printing apparatus, in which an inducement-assistant electrode is provided in the form of a needle, according to the embodiment of FIG. 6, FIG. 14 is an enlarged view showing a jet result of the printing apparatus, in which an inducement-assistant electrode is provided in the form of aluminum (Al) foil, according to the embodiment of FIG. 6, FIG. 15 is an enlarged view showing a result of repair printing for an electrode of a thin film transistor by the printing apparatus manufactured according to the disclosure, and FIG. 16 is an enlarged view showing a result of printing conductive glue for bonding a micro light emitting diode (LED) by the printing apparatus manufactured according to the disclosure.

First, FIG. 9 shows the jet results when AC voltage is applied in the state that the main electrode 120 coated with epoxy polymer is inserted into the nozzle 110 in the printing apparatus described with reference to FIG. 1. As shown therein, the jet was achieved with a fine linewidth of 15~16 μm at the maximum voltage not lower than 0.4 kV.

Further, FIG. 10 shows the jet results when AC voltage is applied in the state that the main electrode 120 coated with fluoropolymer is inserted into the nozzle 110 in the printing apparatus described with reference to FIG. 1. As shown therein, the jet was achieved with a fine linewidth of 13~14 μm at the maximum voltage not lower than 0.4 kV.

From FIGS. 9 and 10, it will be appreciated that the jet of the fine linewidth is possible even though there are minute differences in the linewidth according to the materials of the insulating layer 130 coated on the outer surface of the main electrode 120.

FIG. 11 shows the jet results when AC voltage is applied in the state that the main electrode 220 is formed outside the nozzle 210 made of the insulator in the printing apparatus described with reference to FIG. 5. Further, FIG. 12 shows the jet results in the state that the main electrode 220 is formed outside the nozzle 210 made of the insulator and the inducement-assistant electrode 250 is additionally formed inside the nozzle 210 in the printing apparatus described with reference to FIG. 6.

The jet in FIG. 11 was achieved without forming a line and a little bit unstable, but the jet in FIG. 12 was stably achieved forming a line with a fine linewidth of 12~13 μm when the inducement-assistant electrode 250 is disposed inside the nozzle 210.

Likewise, FIG. 13 shows the jet results in the state that the inducement-assistant electrode 250 is provided in the form of the needle in the printing apparatus described with reference to FIG. 6, and FIG. 14 shows the jet results in the state that the inducement-assistant electrode 250 is provided in the form of the aluminum foil in the printing apparatus described with reference to FIG. 6

The jet in FIG. 13 was achieved with a fine linewidth of 8~10 μm at the maximum voltage not lower than 0.4 kV, and the jet in FIG. 14 was achieved with a fine linewidth of 7~8 μm at the maximum voltage not lower than 0.95 kV.

Thus, it will be appreciated that the jet characteristics are a little varied depending on the configurations of the inducement-assistant electrode 250, and enhanced in all the cases of including the inducement-assistant electrode 250.

Meanwhile, a thin film transistor for driving a pixel is formed on a backplane of an OLED or the like display, and the source, drain and gate electrodes of the thin film transistor are too fine to be perfectly formed by a photo process and an etching process. Accordingly, open (defective) electrodes are subjected to repair printing. FIG. 15 shows a result of the repair printing performed by a printing system of the disclosure.

Referring to FIG. 15, the left side shows broken electrodes having a linewidth of 2 μm, and the right side shows the broken electrodes are reconnected by the printing apparatus of the disclosure. In this case, a printing material is ink that contains Ag nanoparticles, a binder, and a solvent.

A conductive nano-ink composition to be printed according to the disclosure refers to a jet solution that is used in EHD jet printing and contains a conductive nanostructure, a high-molecular compound, a wetting and dispersing agent, and an organic solvent. The conductive nanostructure is excellent in electrical, mechanical and thermal properties, and thus employed as a basic material for the conductive nano-ink composition. The conductive nanostructure may have nanoparticles; a nanowire, a nanorod, a nanopipe, a nanobelt, a nanotube or the like one-dimensional nanostructure; or combination of the nanoparticles and the one-dimensional nanostructure. Further, the conductive nanostructure may be the nanostructure including one or more selected from a group consisting of gold (Au), silver (Ag), aluminum (Al), nickel (Ni), zinc (Zn), copper (Cu), silicon (Si) or titanium (Ti); a carbon nanotube (CNT); or combination thereof. The high-molecular compound is to adjust the viscosity and optical characteristics of the conductive nano-ink composition, and may include a natural high-molecular compound, a synthetic high-molecular compound, etc. without limitations. According to an exemplary embodiment, the natural high-molecular compound may include at least one among chitosan, gelatin, collagen, elastin, hyaluronic acid, cellulose, silk fibroin, phospholipids and fibrinogen, and the synthetic high-molecular compound may include at least one among poly(lactic-co-glycolic acid) (PLGA), poly(lactic acid) (PLA), poly(3-hydroxybutyrate-hydroxyvalerate) (PHBV), Polydioxanone (PDO), polyglycolic acid (PGA), poly(lactide-caprolactone)

(PLCL), poly(ecaprolactone) (PCL), poly-L-lactic acid (PLLA), poly(ether urethane urea) (PEUU), cellulose acetate, polyethylene oxide (PEO), poly(ethylene vinyl alcohol (EVOH), polyvinyl alcohol (PVA), polyethylene glycol (PEG) and polyvinylpyrrolidone (PVP). According to the kinds of conductive nanostructure, combination of the natural high-molecular compound and the synthetic high-molecular compound may be used. According to the disclosure, when the ink composition is actualized using the silver nanowire as the conductive nanostructure, the high-molecular compound of PEG or PEO is the most appropriate for controlling control the viscosity.

Meanwhile, micro-LED chips may be arrayed and bonded to manufacture a large format display. To this end, there is a need of patterning conductive glue on a substrate. The size of micro-LED is not greater than 100 μm, and therefore the size of pad for bonding the micro-LED should not be greater than 20 μm.

The photograph in FIG. 16 shows a result that conductive glue given in the form of an Ag precursor for bonding the LED is printed with a size of 15 μm.

In the foregoing induced EHD jet printing apparatus according to the disclosure, the solution in the nozzle and the main electrode are isolated by the insulator, thereby solving problems of generation of heat, denaturation of the solution, clogging of the nozzle, and generation of bubbles, caused by an oxidation-reduction reaction due to voltage applied to the electrode through contact between the solution and the electrode.

Although there is no electric charge transfer caused by direct contact between the electrode and the solution, the jet is possible based on the induced electrostatic force exerted on the liquid surface at the nozzle tip by the electric field, thereby lowering sensitivity of the jet depending on the electric conductivity of the solution.

Further, the inducement-assistant electrode is provided inside the nozzle separately from the main electrode, thereby reinforcing the induced electric field and thus improving the jet characteristics.

Although a few exemplary embodiments of the present disclosure have been shown and described, these are for illustrative purpose only and it will be appreciated by those skilled in the art that changes may be made in these embodiments without departing from the principles and spirit of the invention, the scope of which is defined in the appended claims and their equivalents.

What is claimed is:

1. An induced electrohydrodynamic (EHD) jet printing apparatus comprising:

a nozzle configured to discharge a fed solution to an opposite substrate;

a main electrode contactlessly isolated from the solution inside the nozzle by an insulator; and a voltage supplier configured to apply voltage to the main electrode.

2. The induced EHD jet printing apparatus according to claim 1, wherein the voltage supplier applies a direct current (DC) voltage to the main electrode.

3. The induced EHD jet printing apparatus according to claim 1, wherein the voltage supplier applies an alternating current (AC) voltage to the main electrode.

4. The induced EHD jet printing apparatus according to claim 3, wherein the voltage supplier applies the AC voltage, which comprises a waveform of at least one among a sinusoidal wave, a triangle wave, and a square wave, to the main electrode.

5. The induced EHD jet printing apparatus according to claim 1, wherein the main electrode is coated with the insulator and inserted into the nozzle.

6. The induced EHD jet printing apparatus according to claim 5, wherein the main electrode is shaped like a needle.

7. The induced EHD jet printing apparatus according to claim 5, wherein the main electrode is shaped like a tube.

8. The induced EHD jet printing apparatus according to claim 5, further comprising an inducement-assistant electrode that is made of a conductive material and coated on an inner wall of the nozzle, and that does not have electric connection, is supplied with voltage different in level from the voltage for the main electrode, or grounded.

9. The induced EHD jet printing apparatus according to claim 8, wherein a surface of the inducement-assistant electrode is coated with an insulator.

10. The induced EHD jet printing apparatus according to claim 1, wherein the nozzle is formed of the insulator, and the main electrode is formed on an outer wall of the nozzle or at a position spaced apart from an outside of the nozzle.

11. The induced EHD jet printing apparatus according to claim 10, further comprising an inducement-assistant electrode that is made of a conductive material and inserted into the nozzle, and that does not have electric connection, is supplied with voltage different in level from the voltage for the main electrode, or grounded.

12. The induced EHD jet printing apparatus according to claim 11, wherein the inducement-assistant electrode is shaped like a needle.

13. The induced EHD jet printing apparatus according to claim 11, wherein the inducement-assistant electrode is provided as aluminum foil and inserted into the nozzle.

14. The induced EHD jet printing apparatus according to claim 11, wherein a surface of the inducement-assistant electrode is coated with an insulator.

15. The induced EHD jet printing apparatus according to claim 1, wherein the nozzle comprises a main electrode portion made of a conductive material and forming a body, and an insulating portion made of the insulator and coated on the main electrode portion, and the voltage supplier is configured to apply voltage to the main electrode portion.

16. The induced EHD jet printing apparatus according to claim 15, further comprising an inducement-assistant electrode that is made of a conductive material and inserted into the nozzle, and that does not have electric connection, is supplied with voltage different in level from the voltage for the main electrode portion, or grounded.

17. The induced EHD jet printing apparatus according to claim 16, wherein the inducement-assistant electrode is shaped like a needle.

18. The induced EHD jet printing apparatus according to claim 16, wherein the inducement-assistant electrode is provided as aluminum foil and inserted into the nozzle.

19. The induced EHD jet printing apparatus according to claim 16, wherein a surface of the inducement-assistant electrode is coated with an insulator.

* * * * *